US006155014A

United States Patent [19]

Wagner

[11] Patent Number: 6,155,014

[45] Date of Patent: Dec. 5, 2000

[54] CLEAN ROOM WALL SYSTEM

[75] Inventor: S. Ross Wagner, Tigard, Oreg.

[73] Assignee: Unistrut International Corporation, Wayne, Mich.

[21] Appl. No.: 09/271,401

[22] Filed: Mar. 17, 1999

[51] Int. Cl.[7] ..... E04B 2/74

[52] U.S. Cl. ..... 52/281; 52/282.2; 52/239; 52/775; 52/270; 52/582.1

[58] Field of Search ..... 52/281, 282.2, 52/238.1, 239, 243, 235, 775, 284, 286, 270, 582.1

[56] References Cited

U.S. PATENT DOCUMENTS

| | | | |
|---|---|---|---|
| 4,625,483 | 12/1986 | Zacky et al. | 52/239 |
| 4,652,170 | 3/1987 | Lew | 403/381 |
| 4,984,400 | 1/1991 | Bockmiller | 52/241 |
| 5,307,600 | 5/1994 | Simon, Jr. et al. | 52/241 |
| 5,414,967 | 5/1995 | Cates et al. | 52/281 |
| 5,634,300 | 6/1997 | Huebner et al. | 52/36.1 |
| 5,806,258 | 9/1998 | Miedema et al. | 52/220.7 |
| 6,052,958 | 4/2000 | Miedema et al. | 52/284 |

*Primary Examiner*—Christopher T. Kent
*Assistant Examiner*—Jennifer I. Thissell
*Attorney, Agent, or Firm*—Banner & Witcoff, Ltd.

[57] ABSTRACT

There is disclosed a non-progressive modular wall system for wall heights greater than eight feet that does not require excessive demolition of adjacent wall panels and framing posts above and below the moment connection, typically at the eight foot level. The wall system assembly includes framing at the moment connection comprising connector or junction blocks fastened to the ends of the framing posts. The connector blocks abut each other and are fastened together at the moment connection and allow for selective removal of the framing posts. The disclosed wall system meets the lateral load and deflection requirements for non-progressive wall systems having wall heights greater than eight feet.

17 Claims, 7 Drawing Sheets

FIG. 5
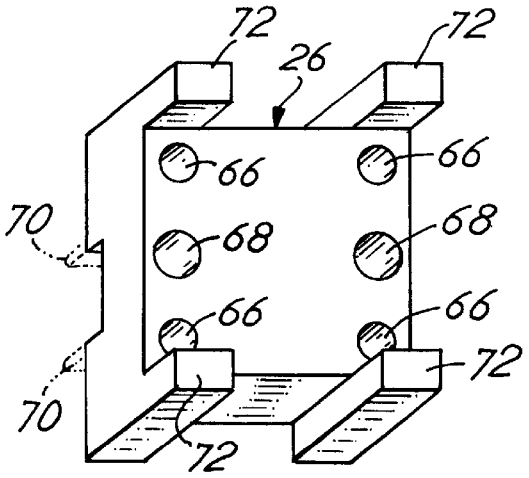
FIG. 6
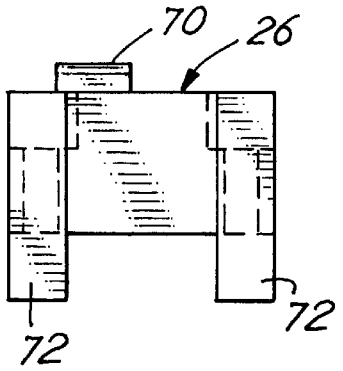
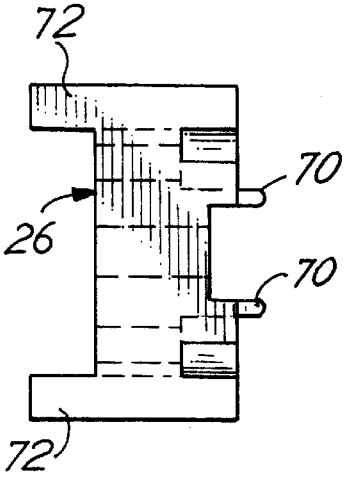
FIG. 7
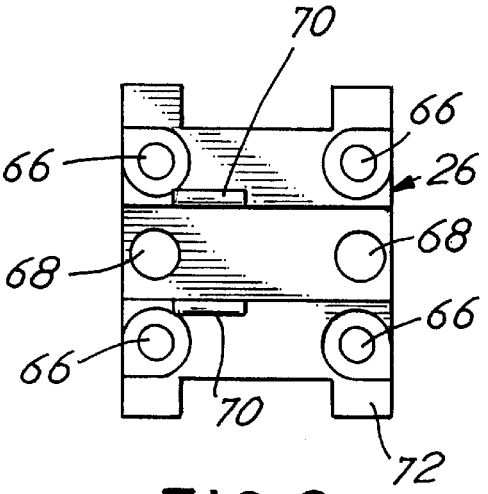
FIG. 8

FIG.11
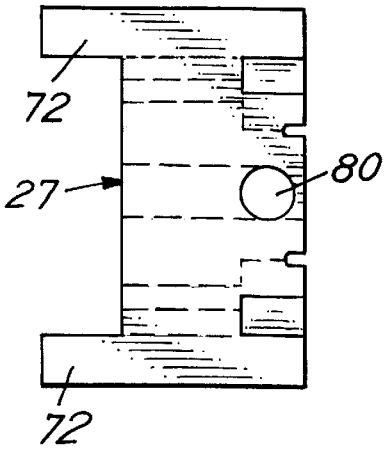
FIG.12
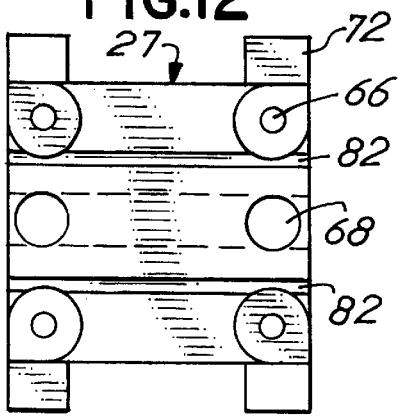
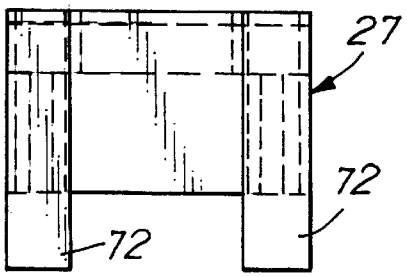
FIG.13
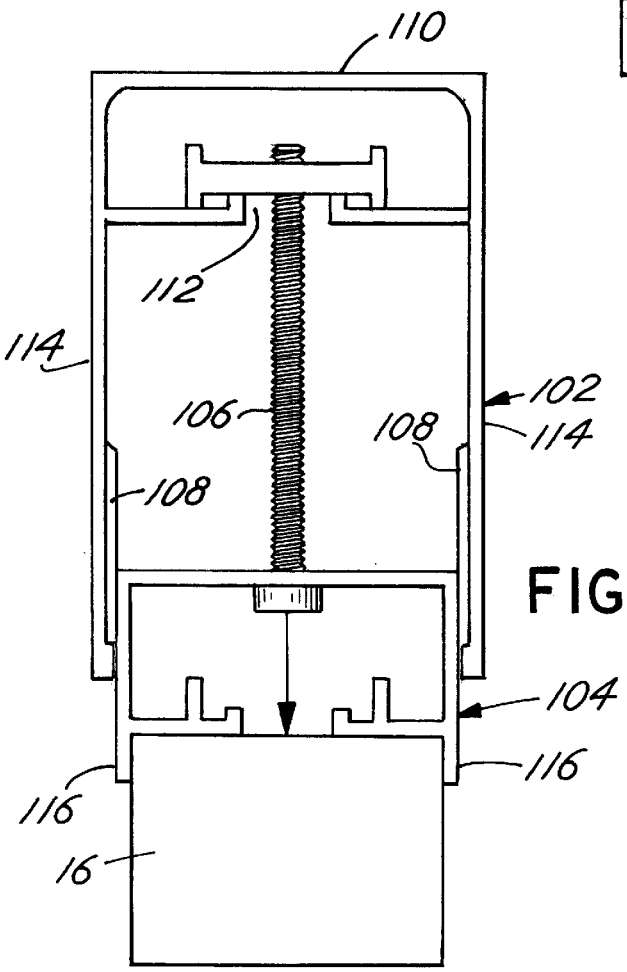
FIG.14

CLEAN ROOM WALL SYSTEM

BACKGROUND OF THE INVENTION

1. Field of the Invention

The present invention relates in general to wall systems for clean rooms. More specifically, but without restriction to the particular use which is shown and described, this invention relates to non-progressive clean room wall systems having wall heights greater than eight feet.

2. Description of the Related Art

There is an increasing need for cleaner environments in which laboratory procedures and high technology component production, such as, semiconductor chip manufacture, may be undertaken. Clean room wall systems, such as the Slimline 200 wall system, manufactured by Unistrut Corporation, provide a suitably clean environment and allow for a variety of wall configurations depending on the particular application. There is also a need for clean room wall systems that are non-progressive, that is, wall systems where the wall panels are demountable from the wall without having to tear down or remove an adjacent panel.

The non-progressive wall assembly generally consists of framing members, panel retainers and wall panels. The framing members are the horizontal and vertical support posts that provide the wall system with its structural integrity. Attached to the framing members are the panel retainers, also known as battens. The battens capture the wall panels, permit components to be mounted onto the wall, and serve as trim to cover the framing members and the junctures between the framing members. It is the battens in a non-progressive wall system that permit the removal of single wall panels in a continuous wall without removing the adjacent panels or the framing members. The wall panels of a cleanroom wall assembly can be made of various materials so long as the material is non-particulating and non-off-gassing. For a disclosure of non-progressive clean room wall systems, U.S. Pat. No. 5,414,967, issued May 16, 1995, and U.S. Pat. No. 5,307,600, issued May 3, 1994, both assigned to Unistrut International Corporation, are incorporated herein by reference.

Traditionally, clean room wall systems were manufactured for wall heights of 8 to 9 feet. The wall systems designed for these heights could accommodate the lateral loads and deflection limits required by users of these wall systems. However, with the desire for wall systems to accommodate wall heights of 11 to 12 feet, new designs are now needed to provide for this wall height and yet maintain specific loading and deflection requirements.

Specifically, clean room wall systems of 11 to 12 feet must be designed to handle lateral loads of approximately 5 pounds per square feet with a deflection of L/120 or less—L being defined as the wall height in inches. Moreover, the wall systems for 12 foot ceiling heights need to allow for the removal of a lower section of the wall below a chosen elevation, for example at the 8 foot level, while leaving the upper wall section structurally intact. At the 8 foot level, the wall system still must withstand the moment conditions created at that level. One design that has been mostly successful in fulfilling these requirements is installing at the 8 foot level, a horizontal header that extends the entire length of the wall system and mounting 3 or 4 foot panels and framing members above the horizontal header. However, this design fails from a practical standpoint in that equipment taller than 8 feet cannot fit through the wall because of the horizontal continuous header at the 8 foot level. Because of this horizontal continuous header, excessive demolition of the wall system is required, including the removal of several adjacent panels. This extra demolition and panel removal defeats the purpose and intent of a non-progressive wall system and creates an objectionable amount of contamination of the work space by airborne particles and other debris.

SUMMARY OF THE INVENTION

The present invention recognizes and provides a solution to the aforementioned problems associated with non-conventional wall system heights. Accordingly, an object of the present invention is to provide a clean room wall system that is non-progressive and does not require excessive demolition of adjacent panels and framing posts. Another object is to provide a wall system that does not use a continuous horizontal header. Still another object of the present invention is to provide a wall system having a height of 11 to 12 feet that also meets the lateral load and deflection requirements for non-progressive wall systems. Yet another object is to permit equipment taller than 8 feet to pass through the clean room wall without excessive demolition of adjacent panels or framing posts.

Briefly, in summary, the present invention provides a post assembly for a clean room wall system comprising a plurality of framing posts and connector blocks mounted to the ends of the framing members. At the moment connection where four wall panels are joined at a common point, the connector blocks abut each other and are removably fastened together. The connector blocks serve to splice aligned framing posts and to provide structural integrity to the framing members. The connector block arrangement permits the selective removal of the framing posts and adjacent wall panels. For wall systems having heights of 11 or 12 feet, the use of the disclosed connector block arrangement at the eight foot moment connection creates a framing assembly that satisfies the lateral load requirements for wall systems of these heights.

The fill range of objects, aspects and advantages of the invention are only appreciated by a full reading of this specification and a full understanding of the invention. Therefore, to complete this specification, a detailed description of the invention and the preferred embodiment follows, after a brief description of the drawings.

BRIEF DESCRIPTION OF THE DRAWINGS

The preferred embodiment of the invention will be described in relation to the accompanying drawings. In the drawings, the following figures have the following general nature:

FIG. 5 is an isometric view of a connector block of the invention of FIG. 1.

FIG. 6 is a side elevation view of the connector block of FIG. 5.

FIG. 7 is a side elevation view of the connector block of FIG. 5.

FIG. 8 is a top plan view of the connector block of FIG. 5.

FIG. 11 is a side elevation view of an alternative embodiment of a connector block of the invention of FIG. 1.

FIG. 12 is a top plan view of the connector block of FIG. 11.

FIG. 13 is a side elevation view of the connector block of FIG. 11.

FIG. 14 is a side elevation view of a head track of the invention of FIG. 1.

In the accompanying drawings, like reference numerals are used throughout the various figures for identical structures.

DESCRIPTION OF THE PREFERRED EMBODIMENTS

Figure 1:
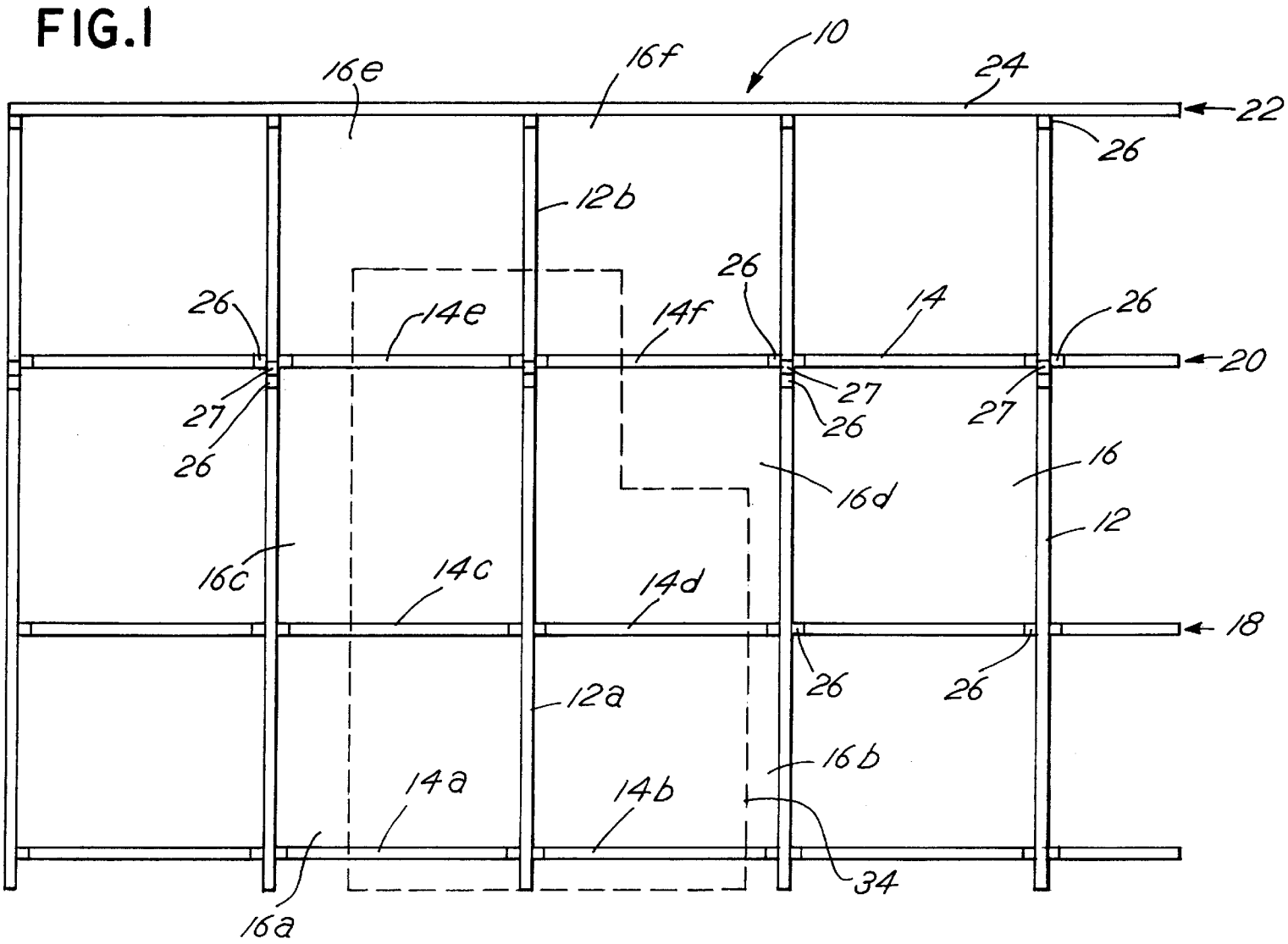
FIG. 1 is a side view of a configuration of the wall system assembly according to the present invention.

Referring now in detail to the illustrative preferred embodiments depicted in the accompanying drawings, there is shown in FIG. 1 a portion of a non-progressive modular wall system embodying various features of the present invention. The wall system 10 comprises a plurality of elongated vertical posts 12, horizontal posts 14, and wall panels 16. The wall system 10 has an overall height of 12 feet with horizontal posts 14 located approximately at the four-foot level 18 and at the eight-foot level 20. At the twelve-foot level 22 is the head track 24 which runs continuously along the top of the wall system 10 and fastens directly into the ceiling of a clean room. The horizontal and vertical posts are connected to each other through the use of connector or juncture blocks 26, generally depicted in FIG. 1.

Figure 2:
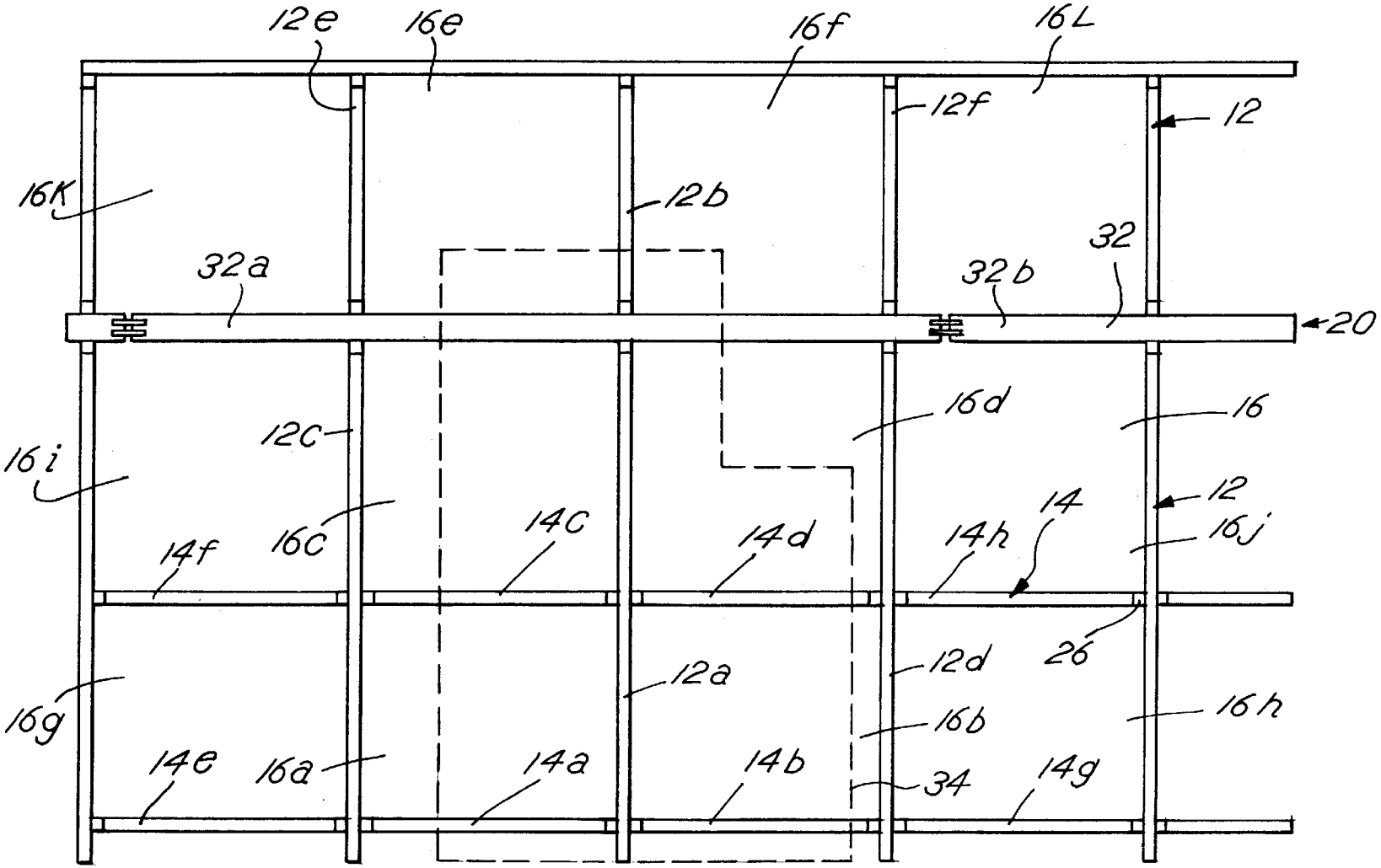
FIG. 2 is a side view of a prior art configuration of a wall system assembly.

Referring to FIG. 2, there is shown a wall system consisting of the same horizontal and vertical posts and wall panels. However, at the eight-foot level 20, there is depicted a horizontal header 32 of the prior art which is designed and utilized to accommodate the loading and moment conditions created at that level. The horizontal header 32 is a horizontal support member which reinforces the wall system at the eight-foot level. As shown in FIG. 2, the horizontal header 32 overlaps or extends over several vertical posts and abuts with and is connected to an adjacent header. The problems with this wall system over the illustrated preferred embodiment of the inventive wall system 10 of FIG. 1 is best described with reference to the object 34, depicted by dashed lines. The object 34 represents a piece of equipment of a height greater than eight feet that may be moved through the wall into the clean room. In order for the object 34 to pass through the non-progressive wall system of FIG. 2, the panels, vertical and horizontal posts, and horizontal header which the object is shown to overlap must be removed, including all adjacent panels and vertical posts, along with the panels and posts above the header. That is, horizontal posts 14*a,* 14*b,* 14*c,* 14*d,* 14*e,* 14*f,* 14*g,* 14*h,* vertical posts 12*a,* 12*b,* 12*c,* 12*d,* panels 16*a,* 16*b,* 16*c,* 16*d,* 16*e,* 16*f,* 16*g,* 16*h,* 16*i,* 16*j,* and horizontal header 32*a* must be removed to permit the object 34 to pass through the wall. However, with the removal of the prior art header 32*a,* the panels and vertical posts above the header must also be removed, thereby creating more demolition of the wall system and more contamination of the clean room which is highly undesirable. That is, vertical posts 12*e,* 12*f,* and panels 16*k,* 16L, must also be removed.

Referring to FIG. 1, the extra demolition of the wall system above the eight-foot level is avoided through the use of the inventive assembly herein described. As shown in FIG. 1, only the horizontal posts 14*a,* 14*b,* 14*c,* 14*d,* 14*e,* 14*f,* vertical posts 12*a,* 12*b,* and panels 16*a,* 16*b,* 16*c,* 16*d,* 16*e,* 16*f,* need to be removed to accommodate the passing through of the object 34. This inventive assembly reduces the amount of demolition and resulting contamination yet still provides the structural strength at the eight-foot moment connection to satisfy the desired loading conditions. The loading requirements are satisfied by the unique arrangement of connector blocks at the eight-foot level, more fully described below.

Figure 3:
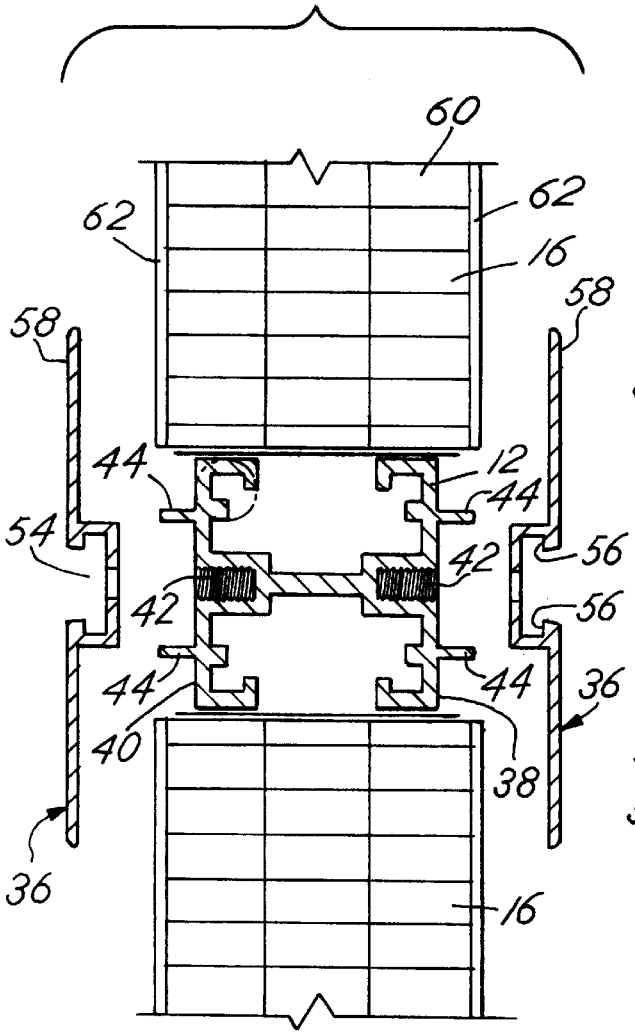
FIG. 3 is a top plan view of the framing posts and wall panels of the invention of FIG. 1.
Figure 4:
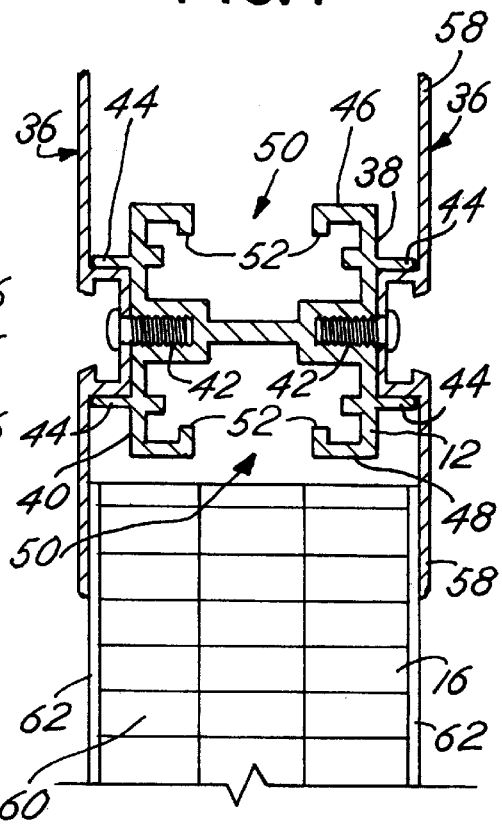
FIG. 4 is a top plan view of the framing posts and wall panels of the invention of FIG. 1.
Figure 15:
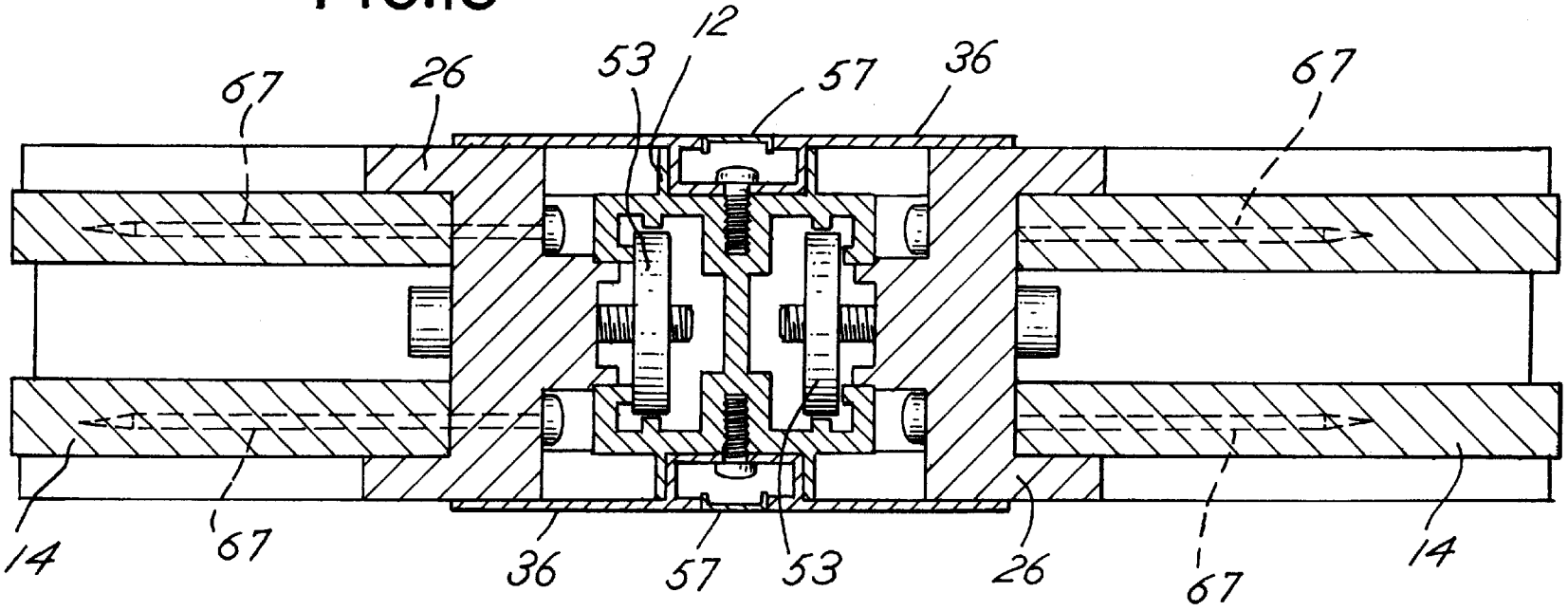
FIG. 15 is a top plan view of the connection between the horizontal and vertical posts of the invention of FIG. 1.

Referring to FIGS. 3 and 4, a vertical post 12 is depicted in cross-section along with panels 16 adjacent the post 12. Also depicted is a pair of panel retainers or battens 36 holding the panels 16 to the post 12. The vertical post 12 defines an elongated body having a generally square cross-section, and preferably of an aluminum extrusion. The horizontal post 14 has the same elongated body and cross-section as the vertical post. The horizontal and vertical posts define four sides or surfaces. Sides 38 and 40 define a closed face, a threaded channel 42, and a pair of fences 44 disposed on opposing sides of the threaded channel. Sides 46 and 48 define an open face or cavity 50 and inner shoulders 52 to receive channel nut fasteners 53, as shown in FIG. 15. Mounted to the closed face between the pair of fences are the battens 36.

The battens 36 serve as wall panel retainers, component mounting members, and as trim to cover the posts and the junctures between the posts. The battens are removably mounted to the threaded channel 42 on sides 38 and 40 of the post. The battens define a central channel 54 having inner shoulders 56 facing each other. Insertable and slidable within the batten central channel are component mounting fasteners for mounting computer tables or shelves on the wall. Also insertable within the batten central channel 54 is a dress strip 57, depicted in FIG. 15. The dress strip 57 is typically made from a resilient elastomeric material and is snap-fitted within the central channel to cover the central channel. The batten also has flanges 58 that extend outward in opposite directions of the batten central channel. When installed, the batten flanges extend past the post to serve as panel retainers. Depending on the desired application, the battens may have different widths, measured from the extent of the batten flanges. Typically, the pocket formed between the opposing batten flanges accommodates a standard 1⅞ inch width panel. However, if a narrower panel is desired, spacers, not shown, may be fitted between the opposing batten flanges to hold, for example, a one-quarter inch panel.

The panels used in the non-progressive wall assembly typically consist of a honeycomb structural core 60 having an attached pair of thin faces formed as thin plates 62. The honeycomb core is conventionally made of aluminum sheet, although other types of cores such as corrugated fiberous material may be used. The thin plates 62 are customarily bonded to the honeycomb core by a suitable non-off-gassing structural adhesive. The faces of the thin plates are coated with a chemical resistant and cleanable coating such as polyester. As shown in FIG. 3, the panels 16 are removable from either side of the wall assembly by simply removing the batten 36 on that side. This allows for ease of interchangeability of the panels and promotes access to the interior of the wall assembly.

A connector block is used to mount a horizontal post to a vertical post. In a preferred embodiment, it is also used at the eight-foot level to splice or connect two vertical posts. The preferred connector block connection at the eight-foot level creates a wall that satisfies the loading and deflection requirements for walls having a height of 12 feet. Referring to FIGS. 5–7 and 15, a preferred connector block 26 is illustrated and defines a relatively cubic body having four counter-sunk holes 66 in each of the corners to receive threaded fasteners 67 which removably attach the connector block 26 to the end of the post. The connector block 26 also defines a pair of slightly larger holes or apertures 68 extending through the width of the block at two opposing sides. The pair of holes 68 provides the opening for the channel nut fasteners 53 to pass through and mount the connector block and accompanying horizontal post to the open elongated cavity 50 in the vertical post. The connector block 26 further defines alignment tabs 70 and four legs 72 at the corners which serve as support members for the skin or thin plates 62 of the wall panel 16.

Figure 9:
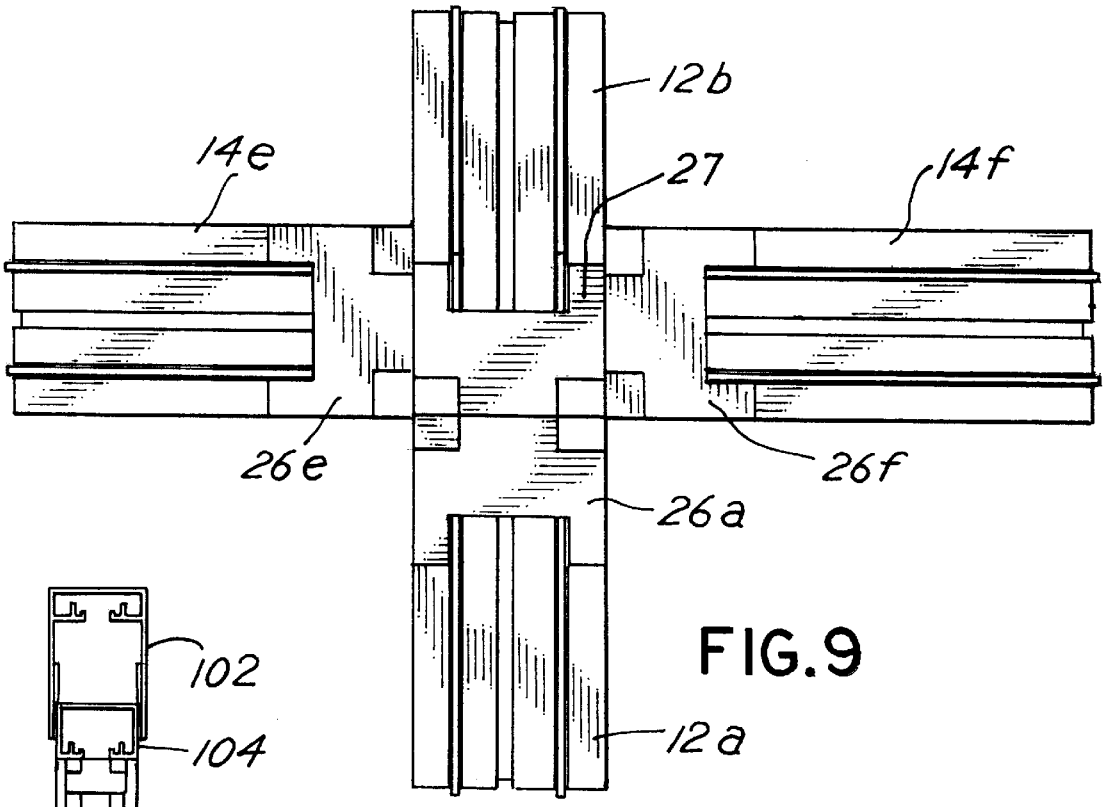
FIG. 9 is a side elevation view of the framing at a moment connection.
Figure 10:
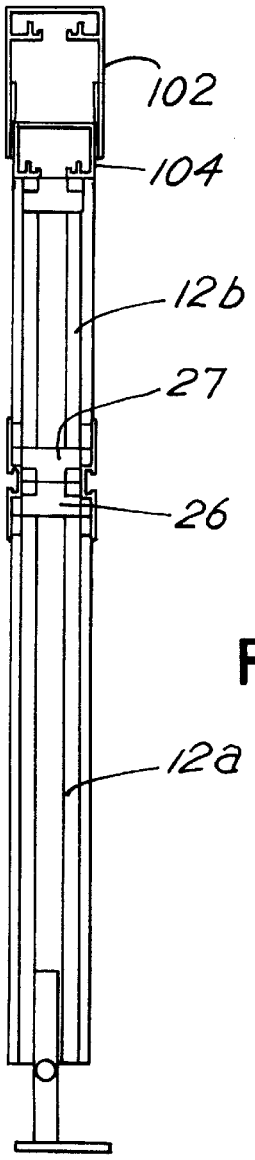
FIG. 10 is an end elevation view of the wall system of the invention of FIG. 1.

Referring to FIGS. 9 and 10, framing at a moment connection is depicted, preferably at the eight-foot level. At this connection, four wall panels are joined at a common point. The vertical posts 12 are mounted normal to the horizontal posts 14 through the use of the connector block assembly. As preferred, connector blocks 26*a* and 27 splice the vertical posts 12*a* and 12*b* together. Connector blocks 26*e* and 26*f* which are connected to the ends of the horizontal posts 14*e* and 14*f*, respectively, are mounted to the elongated cavity 50 in the vertical posts through the use of channel fasteners. The blocks 26*e* and 26*f* are also fastened to the connector block 27.

Referring to FIGS. 11–13, connector block 27 is exemplified and includes a hole 80 through the body of the connector block. The hole or aperture 80 is perpendicular to the holes 68 and counter-sunk holes 66. The hole 80 allows for a fastener to pass through the connector block 27 to mount the connector blocks 26*e* and 26*f* and thus the horizontal posts 14*e* and 14*f* to the vertical post at the 8 foot level moment connection. Grooves 82 are located along the body of the connector block 27 and are sized and shaped to received the alignment tabs 70 of the connector block 26*a*.

Significantly, when it is desirable to remove a lower and upper panel of the wall assembly to permit the installation of equipment taller than the height at the moment connection, for example, the eight-foot level, using the disclosed connector block assembly only requires the removal of the upper and lower wall panels and the horizontal post located between the upper and lower wall panels. In contrast with conventional wall systems where removal of the horizontal header requires removal of the adjacent wall panels above the header, the present invention requires less demolition of the wall system, thereby decreasing the amount of objectionable contamination during demolition. Moreover, with the use of the connector block assembly of the present invention, the lateral loading and deflection requirements for wall systems having wall heights of 11 to 12 feet are achieved.

Referring to FIG. 14 there is shown a head track 102. The head track is a conventional ceiling track that fastens into the cleaning grid of a clean room for mounting of the vertical wall panels to the ceiling. The head track 102 is an aluminum extrusion comprising a closed end 110, an inner channel 112 for receiving channel nut fasteners 106 and a pair of laterally spaced legs 114 extending downward from the closed end. Mounted vertically within the head track is the top track 104. The top track 104 and attached wall panel 16 are removably mounted to the head track 106 through the use of channel nut fasteners 106. The top track is an aluminum extrusion defining a pair of downwardly extending legs 116 for receiving the wall panel 16. Between the top track and head track are elongated gaskets 108. The gaskets, as conventional, are a resilient rubber material that center the top track 104 in the head track 102 and prevent lateral movement of the wall panel. The gaskets also serve other functions. First, the gaskets permit vertical motion of the head track relative to the top track and thus accommodate at least ¾ inch ceiling deflection. Second, the gaskets prevent the passage of air and accompanying contaminant particles through the wall panel.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. A wall system for clean rooms comprising:

a plurality of elongated framing members positioned to form a structural framework, including a first elongated framing member having an end, a first connector block mounted to the end of the first framing member, a second elongated framing member substantially identical to the first framing member and having an end, a second connector block mounted to the end of the second framing member, the second connector block abutting and mounted to the first connector block, the first framing member being in alignment with the second framing member, a third elongated framing member substantially identical to the first framing member and having an end, a third connector block mounted to the end of the third framing member, the third connector block abutting and mounted to the second connector block, the third framing member mounted substantially perpendicular to the first and second framing members, a fourth elongated framing member substantially identical to the first framing member and having an end, and a fourth connector block mounted to the end of the fourth framing member, the fourth connector block abutting and mounted to the second connector block, the fourth framing member mounted substantially perpendicular to the first and second framing members and in alignment with the third framing member.

2. The wall system of claim 1 wherein the first elongated framing member further defines a front surface and an opposed rear surface, the front and rear surfaces define an elongated threaded channel.

3. The wall system of claim 2 wherein the front and rear surfaces of the first elongated framing member include at least one fence extending outwardly from the front and rear surfaces.

4. The wall system of claim 2 wherein a batten is mounted to the threaded channel of the front and rear surfaces, the batten having a central body and a pair of opposing flanges extending outwardly from the central body past the first framing member to serve as a wall panel retainer.

5. The wall system of claim 4 further comprising a wall panel received in the flanges of the battens mounted on the front and rear surfaces of the first framing member.

6. The wall system of claim 1 further comprising a fastener, the fastener mounting the third and fourth connector blocks to the second connector block.

7. A wall system for clean rooms comprising:

a plurality of elongated framing members positioned to form a structural framework, including a first elongated framing member having an end, a first connector block mounted to the end of the first framing member, a second elongated framing member having an end and a first side surface and an opposing second side surface, the first and second side surfaces each defining a channel, a second connector block mounted to the end of the second framing member, the second connector block abutting and mounted to the first connector block, the first framing member being in alignment with the second framing member, a third elongated framing member having an end, a third connector block mounted to the end of the third framing member, the third connector block abutting and mounted to the channel of the second framing member, the third framing member mounted substantially perpendicular to the first and second framing members, a fourth elongated framing member having an end, and a fourth connector block mounted to the end of the fourth framing member, the fourth connector block abutting and mounted to the opposing channel of the second framing member, the fourth framing member mounted substantially perpendicular to the first and second framing members.

8. The wall system of claim 7 wherein the first elongated framing member further defines a front surface and an opposed rear surface, the front and rear surfaces define an elongated threaded channel.

9. The wall system of claim 8 wherein the front and rear surfaces of the first elongated framing member include at least one fence extending outwardly from the front and rear surfaces.

10. The wall system of claim 8 wherein a batten is mounted to the threaded channel of the front and rear surfaces, the batten having a central body and a pair of opposing flanges extending outwardly from the central body past the first framing member to serve as a wall panel retainer.

11. The wall system of claim 10 further comprising a wall panel received in the flanges of the battens mounted on the front and rear surfaces of the first framing member.

12. The wall system of claim 7 wherein the channel of the first and second side surfaces receive channel fasteners.

13. The wall system of claim 12 wherein the channel fasteners mount the third and fourth connector blocks to the second elongated framing member.

14. A post assembly for building at least a portion of a clean room wall comprising:

a first elongated framing member having an end, a front surface and an opposing rear surface, and a first side surface and an opposing second side surface, a second elongated framing member having an end, a front surface and an opposing rear surface, and a first side surface and an opposing second side surface, a moment connection between the first and second elongated framing members further comprising a first connector block mounted to the end of the first framing member, and a second connector block mounted to the end of the second framing member, the first connector block abutting and fastened to the second connector block, the first framing member being in alignment with the second framing member, and a batten mounted to at least one surface of the first framing member.

15. The post assembly of claim 14 further comprising a third elongated framing member having an end, a third connector block mounted to the end of the third framing member, a fourth elongated framing member having an end, and a fourth connector block mounted to the end of the fourth framing member, the third and fourth connector blocks abutting and removably fastened to the second connector block, the third and fourth framing members mounted substantially perpendicular to the first and second framing members.

16. The post assembly of claim 15 further comprising battens mounted to the third and fourth framing members, the battens receiving and holding wall panels, the battens allowing selective removal of the wall panels.

17. The post assembly of claim 14 wherein the first and second connector blocks have apertures in alignment, the apertures receiving a fastener for attaching the first connector block to the second connector block.

* * * * *

UNITED STATES PATENT AND TRADEMARK OFFICE

CERTIFICATE OF CORRECTION

PATENT NO : 6,155,014

DATED : December 5, 2000

INVENTOR(S) : S. Ross Wagner

It is certified that error appears in the above-identified patent and that said Letters Patent are hereby corrected as shown below:

Col. 2, line 38 "fill" should be - full -

Signed and Sealed this

Eighth Day of May, 2001

*Attest:*

Nicholas P. Godici

NICHOLAS P. GODICI

*Attesting Officer*

*Acting Director of the United States Patent and Trademark Office*